United States Patent [19]

Geitner

[11] Patent Number: 4,790,152

[45] Date of Patent: Dec. 13, 1988

[54] FABRIC DRAW-OFF ARRANGEMENT IN FLAT KNITTING MACHINES

[75] Inventor: Otto Geitner, Bopfingen, Fed. Rep. of Germany

[73] Assignee: Universal Masachinenfabrik Dr. Rudolf Schieber Gmbh & Co., Westhausen, Fed. Rep. of Germany

[21] Appl. No.: 119,769

[22] Filed: Nov. 12, 1987

[30] Foreign Application Priority Data

Nov. 11, 1986 [DE] Fed. Rep. of Germany ..... 3638374

[51] Int. Cl.[4] ..... D04B 15/88

[52] U.S. Cl. ..... 66/149 R

[58] Field of Search ..... 66/149, 150, 152

[56] References Cited

U.S. PATENT DOCUMENTS 4,027,506 6/1977 Bitzer ..... 66/149 R
4,236,390 12/1980 Blank et al. ..... 66/149 R
4,503,689 3/1985 Goller et al. ..... 66/152 X
4,549,412 10/1985 Stoll et al. ..... 66/149 R

*Primary Examiner*—Ronald Feldbaum
*Attorney, Agent, or Firm*—Sughrue, Mion, Zinn, Macpeak & Seas

[57] ABSTRACT

A fabric draw-off arrangement for flat knitting machines has a driven fabric draw-off member consisting of a plurality of roller elements and pressure rollers of a fabric pressure member associated with the roller elements which are mounted on a common rocker shaft and are adjustably and resiliently pressable against the respective roller element. In order during knitting to achieve automatically adjustable reproducibly uniform knitting draw-off, the pressure rollers are together pivotable by motor means into variable end positions and are pivotable from these positions and the pressure force of each pressure roller is individually adjustable by motor means.

10 Claims, 2 Drawing Sheets

FABRIC DRAW-OFF ARRANGEMENT IN FLAT KNITTING MACHINES

The invention relates to a fabric draw-off arrangement in flat knitting machines of the type comprising: a driven fabric draw-off roller consisting of a plurality of roller elements; and pressure rollers of a fabric pressure member associated with the roller elements, mounted on a common rocker shaft and pressable in an adjustable resilient manner against the respective roller element.

A similar fabric draw-off arrangement, in which however the fabric draw-off roller is formed in one piece, is known from DE-C-651296. No drive of the one piece fabric draw-off roller is disclosed.

Furthermore, there is known from FR-A-972602 it is known to provide an electromagnet controlled intermittently by a Jacquard device which magnet in the respective energised condition raises a plurality of pressure rollers together from a one piece fabric draw-off roller via a lever linkage.

The most commonly used fabric draw-off arrangements in flat knitting machines generally have a fabric draw-off roller and a fabric pressure roller. The knitting, coming from the needles, passes between the two rollers and is drawn by a driven fabric draw-off roller. The fabric pressure roller has the purpose of pressing the knitting onto the fabric draw-off roller and determining the wrapping angle through which the knitting passes round the fabric draw-off roller.

In order to optimise the fabric draw-off, the fabric draw-off roller, as known for example from DE-PS No. 3331052, consists of a number of short roller elements corresponding to the needle space width, which elements differentially and mutually independently adjust the knitting draw-off force by spring loading through a predetermined rotational angle. The fabric pressure roller in turn has pressure roll elements which may be resiliently pressed against the respective roller elements.

In order to maintain uniform knitting draw-off during knitting, the pressure rollers must be adjusted more or less independently in respect of their pressure force.

The adjustment depends upon the yarn to be processed and the texture of the knitting which is to be drawn off. When the pressure rollers are set in such manner that the knitting is drawn off uniformly, the mesh rows leaving the fabric draw-off arrangement horizontally or arcuately, and thereafter the entire pressure force must be changed uniformly, all pressure rollers must be moved in parallel and newly adjusted.

The invention is based on the object of providing a fabric draw-off arrangement of the type described with which automatically adjustable reproducibly uniform knitting draw-off is achieved.

This problem is solved according to the invention in that by electro-motor means the pressure rollers are together pivotable into and out of variable end positions, and in that the pressure force of each pressure roller is individually settable by electro-motor means.

Further developments of the invention consist in that the rotation axis of the pivot roller is horizontally and vertically settable by electro-motor means relative to the central axis of the fabric draw-off roller parallel to two coordinate axes or is pivotable in a circular arc about the central axis of the fabric draw-off roller. In this way, the wrap-around angle alpha, through which the knitting passes around the fabric draw-off roller, can be automatically adjusted to the draw-off conditions.

Advantageously, furthermore the pressure rollers are each individually drivable by electro-motor means.

For pivoting of the pressure rollers in and out, expediently an electro-motor is provided which is arranged axially on the pivot shaft.

Furthermore, advantageously for setting the pressure force of the pressure rollers a respective stepping motor is provided to act on a respective pressure spring.

For parallel setting or pivoting of the pivot shaft relative to the fabric draw-off roller, expediently an electro-motor is provided which is connected to the pivot shaft.

Furthermore, for driving the pressure rollers, advantageously individual stepping motors are provided.

The electro-motor for pivoting in and out, the stepping motor for setting the pressure force, the electro-motor for parallel adjustment or pivoting and/or the stepping motors for driving the pressure rollers are advantageously controllable via a machine control device of the flat knitting machine.

The invention will be described in more detail in the following on the basis of exemplary embodiments and with reference to the drawings, in which.

Figure 1:
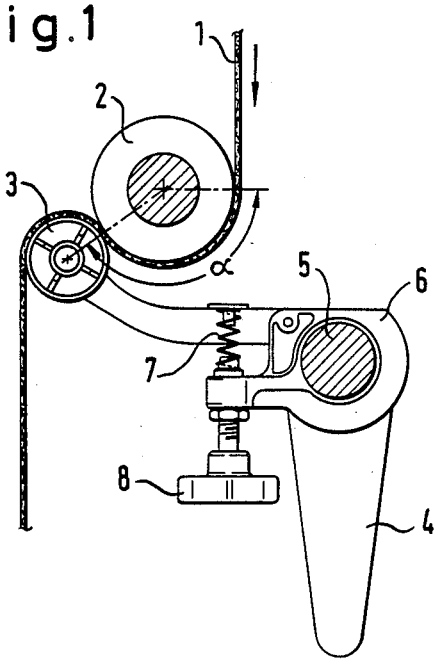
FIG. 1 shows schematically in cross-section a conventional fabric draw-off arrangement having fabric pressure rollers in contact with the fabric draw-off roller.
Figure 2:
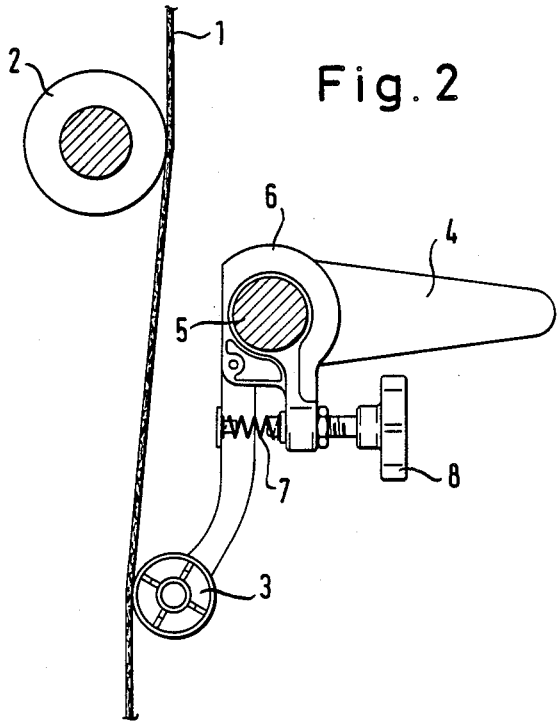
FIG. 2 shows a fabric draw-off arrangement according to FIG. 1 but with outwardly pivotable fabric pressure roller.

The fabric draw-off arrangement illustrated in FIGS. 1 and 2 has a fabric draw-off roller 2 consisting of a plurality of roller elements and a fabric pressure member consisting of a plurality of pressure rollers 3. Knitting 1, coming from non-illustrated needles and passing between the two rollers, is drawn off by the driven fabric draw-off roller 2. The pressure rollers 3 of the fabric pressure member have the purpose of pressing the knitting 1 onto the fabric draw-off roller 2 and establishing the wrap-around angle alpha through which the knitting 1 passes around the fabric draw-off roller 2. In order that the fabric draw-off can be optimised, the fabric draw-off roller 2 consists of a number of shorter roller elements corresponding to the kneedle space width, which elements adjust the knitting draw-off force differentially and independently of one another by spring loading through a predetermined rotational angle. Each roller element has a respective pressure roller 3 of the fabric pressure member. The pressure rollers 3 are mounted on a rotatable and lockable rocker shaft 5 provided with a locking lever or hand grip 4 in such manner that they are exactly opposite the roller elements of the fabric draw-off roller 2. Bearings 6 of the pressure rollers 3 are rigidly connected to the rocker shaft 5. Each pressure roller 3 is spring loaded with the aid of a pressure spring 7 and a clamping screw 8.

The rocker shaft 5, which is rotatably mounted, assumes two positions. The first position is the outwardly pivoted position illustrated in FIG. 2 in which the pressure rollers 3 are not in contacted with the fabric draw-off roller 2. The other position is that illustrated in FIG. 1 in which the pressure rollers 3 are in contact with the fabric draw-off roller 2 and are held locked in this position.

In order during knitting to achieve uniform knitting draw-off, the pressure rollers 3 must be more or less individually adjusted in respect of their pressure force. The adjustment depends on the yarn to be processed and the texture of the knitting which is to be drawn off. The pressure rollers 3 are adjusted in such manner that the knitting 1 is uniformly withdrawn. This is best seen during colour cycling, when the mesh rows must leave the fabric draw-off arrangement horizontally or arcuately. If subsequently the entire pressure force is uniformly changed, all pressure rollers 3 must be moved in parallel and newly adjusted.

The pivoting in and out of the pressure rollers 3 is achieved with the aid of the hand grip 4 which is pinned on the rocker shaft 5 and is operated by hand.

Figure 3:
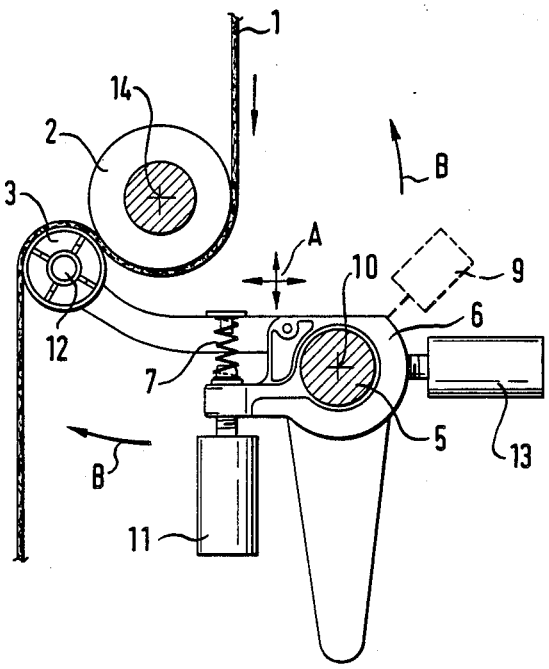
FIG. 3 shows a fabric draw-off arrangement constructed according to the invention in the position illustrated in FIG. 1.

FIG. 3 shows a fabric draw-off arrangement, which, for achieving automatically settable reproducibly uniform knitting draw-off is constructed in such manner that the pressure rollers are pivotable together into variable end positions and are pivotable out of these positions and the pressure force of each pressure roller is settable individually by electro-motor means.

By means of an electro-motor 9 arranged axially on the rocker shaft 5, the pressure rollers 3 can be pivoted by means of an electro-motor into variably pivoted end positions as illustrated in FIG. 3, so that the base position of the various adjusted pressure rollers 3 can be adjusted accordingly on the knitting 1. The outward pivoting of the pressure rollers 3 is likewise achieved together via the electro-motor 9.

Furthermore, in each case a stepping motor 11 is provided operating on each pressure spring 7 of each individual pressure roller 3, by the effect of which stepping motor the pressure force of the pressure rollers 3 can be individually adjusted.

An electro-motor 13 connected to the rocker shaft 5 enables the rotation axis 10 of the rocker shaft 5 to be adjusted relative to the central axis 14 of the fabric draw-off roller 2 either by means of a motor in two coordinate axes horizontally and vertically (double arrows A) or to pivot the rocker shaft 5 by means of a motor through a circular arc about the central axis 14 of the fabric draw-off roller 2 (double arrows B). Thus, the wrap-around angle alpha can be automatically adapted and adjusted by motor means to the draw-off conditions.

In order to adapt the draw-off forces even further to the draw-off conditions, which each of the pressure rollers 3 an individual stepping motor 12 can be provided for driving the pressure rollers 3.

The electro-motor 9, the stepping motor 11, the electro-motor 13 and/or the stepping motor 12 are advantageously controllable via a non illustrated machine control device of the flat knitting machine.

I claim:

1. Fabric draw-off arrangement for a flat knitting machine, comprising a driven fabric draw-off member consisting of a plurality of roller elements and pressure rollers of a fabric pressure member, which are associated with the roller elements and which are mounted on a common rocker shaft and are adjustably and resiliently pressable against the respective roller element, which pressure rollers can be pivoted by electro-motor means together into and out of variable end positions, the pressure force of each pressure roller being individually settable by electro-motor means.

2. Fabric draw-off arrangement according to claim 1 wherein the rotation axis of the rocker shaft is horizontally and vertically adjustable by electro-motor means relative to the central axis of the fabric draw-off member parallel to two coordinate axes.

3. Fabric draw-off arrangement according to claim 1 wherein the rotation axis of the rocker shaft is pivotable by electro-motor means through a circular arc about the central axis of the fabric draw-off member.

4. Fabric draw-off arrangement according to claim 1 wherein the pressure rollers are respectively individually drivable by electro-motor means.

5. Fabric draw-off arrangement according to claim 1 wherein an electro-motor is provided arranged axially on the rocker shaft for pivoting of the pressure rollers in and out.

6. Fabric draw-off arrangement according to claim 1 wherein a stepping motor is provided acting on a respective pressure spring for adjusting the pressure force of the pressure rollers.

7. Fabric draw-off arrangement according to claim 2 wherein for parallel adjustment of the rocker shaft relative to the fabric draw-off member there is provided an electro-motor connected to the rocker shaft.

8. Fabric draw-off arrangement according to claim 3 wherein for pivoting the pivot shaft relative to the fabric draw-off member there is provided an electro-motor connected to the pivot shaft.

9. Fabric draw-off arrangement according to claim 4 wherein for driving the pressure rollers individual stepping motors are provided.

10. Fabric draw-off arrangement according to claim 1 wherein an electro-motor for pivoting in and out, a stepping motor for adjusting the pressure force, an electro-motor for parallel adjustment or pivoting and/or stepping motors for individual drive of the pressure rollers are controllable via a machine control device of the flat knitting machine.

* * * * *